US005310083A

United States Patent [19]

Rizzuto

[11] Patent Number: 5,310,083

[45] Date of Patent: May 10, 1994

[54] CENTER-PULL NOZZLE WITH MODIFIED CONE

[75] Inventor: Jack A. Rizzuto, Antioch, Calif.

[73] Assignee: James River Paper Company, Inc., Richmond, Va.

[21] Appl. No.: 44,152

[22] Filed: Apr. 8, 1993

[51] Int. Cl.[5] ..... B65H 3/26

[52] U.S. Cl. ..... 221/63; 221/303; 221/312 R; 221/47; 225/106

[58] Field of Search ..... 221/303, 312 R, 44, 221/63, 33, 45, 46, 47, 48; 225/106

[56] References Cited

U.S. PATENT DOCUMENTS

| | | | |
|---|---|---|---|
| 1,649,273 | 11/1927 | Wilson | 221/63 X |
| 2,340,090 | 1/1944 | Vineburgh | 221/63 X |
| 3,212,670 | 10/1965 | Tint et al. | 221/312 R |
| 3,214,058 | 10/1965 | Sergio | 221/44 X |
| 4,262,816 | 4/1981 | Margulies | 221/63 X |
| 4,534,491 | 8/1985 | Norton et al. | 221/63 |
| 4,651,895 | 3/1987 | Niake et al. | 221/63 |
| 4,811,878 | 3/1989 | Horinchi | 221/46 X |
| 4,905,868 | 3/1990 | Beane et al. | 221/44 |
| 4,953,746 | 9/1990 | Andriash | 221/63 X |
| 5,054,647 | 10/1991 | Yawata | 221/63 X |
| 5,211,308 | 5/1993 | Decker et al. | 221/303 X |
| 5,215,211 | 6/1993 | Eberle | 221/46 X |

FOREIGN PATENT DOCUMENTS

| | | | |
|---|---|---|---|
| 484907 | 3/1992 | Japan | 221/33 X |

*Primary Examiner*—D. Glenn Dayoan
*Assistant Examiner*—Dean A. Reichard
*Attorney, Agent, or Firm*—Thomas R. Lampe

[57] ABSTRACT

Apparatus for dispensing individual sheets from the center of a coreless roll product comprised of a plurality of the sheets forming a wound web. A dispenser nozzle is connected to a support for supporting the coreless roll. The dispenser nozzle has interconnecting portions, one of which has a truncated cone-like configuration and the other of which has a cylindrical configuration. The portion of the nozzle having the cylindrical configuration is located at the exit opening of the nozzle to provide increased contact area for sheets passing therethrough to reduce wear and extend the life of the nozzle.

3 Claims, 2 Drawing Sheets

CENTER-PULL NOZZLE WITH MODIFIED CONE

TECHNICAL FIELD

This invention relates to the dispensing of sheet material, and more particularly, to apparatus for dispensing individual sheets, such as paper towels, from the center of a coreless roll comprised of a plurality of the sheets.

BACKGROUND ART

A number of dispensers exist in the prior art for dispensing paper toweling and the like. Some of these dispensers are of the "center-pull" type wherein a web of toweling or other sheet material is pulled from the center of a coreless roll through a nozzle or other restricted element forming a restricted passageway. Assuming that the individual sheets of toweling or the like are connected by perforated lines, as is common, the nozzle or other restrictor element will resist pulling of the sheet material by the user, thus breaking an individual sheet from the remaining web along the perforated lien interconnecting same.

It is quite common to utilize center-pull nozzles which have a cone-like or funnel-shaped configuration. For example, U.S. Pat. No. 4,905,868, issued Mar. 6, 1990, discloses a paper towel dispenser employing a conical funnel having an exit hole larger than the entrance hole thereof which provides an exit for paper towels being dispensed. The entrance opening and exit opening of the conical funnel are dimensioned such that a first paper towel will separate from a following paper towel along the perforation boundary therebetween when a leading portion of the following paper towel exits from the exit opening in the funnel.

The cone or funnel-like nozzle disclosed in U.S. Pat. No. 4,905,868 has a characteristic which is believed to be typical of center-pull dispenser nozzles of the cone or funnel type. Namely, the inner and outer walls of the nozzle terminate at a common plane at the bottom of the nozzle, creating a sharp edge where the nozzle exit opening is defined by the nozzle wall. This results in fairly rapid wear of the nozzle at the exit opening and an increase in the size of the exit opening. A change in the dimensions of the nozzle exit opening can result in improper operation of the dispenser. Most commonly, this manifests itself in the inability of the device to provide a clean or complete separation between the lead sheet and that following.

The following patents were also located during a search directed to this invention: U.S. Pat. No. 4,534,491, issued Aug. 13, 1985, U.S. Pat. No. 4,651,895, issued Mar. 24, 1987, U.S. Pat. No. 2,340,090, issued Jan. 25, 1944, U.S. Pat. No. 1,649,273, issued Nov. 15, 1927, and U.S. Pat. No. 4,262,816, issued Apr. 21, 1981. The patents relate to various approaches for dispensing towels and other sheets from a supply thereof by pulling the sheets through a restricted opening to detach one sheet from another.

DISCLOSURE OF INVENTION

The present invention relates to apparatus for dispensing individual sheets from the center of a coreless roll product which employs a dispenser nozzle of specialized construction which reduces the rate of wear at the nozzle exit opening as a result of dispensing.

The coreless roll product is comprised of a plurality of the sheets forming a wound web having a lead end projecting outwardly from the roll center.

The apparatus includes support means for supporting the coreless roll.

A dispenser nozzle defining an aperture for receiving the lead end is connected to the support means and has an inner nozzle wall defining a passageway leading from the aperture away from the support means.

The dispenser nozzle has a distal end defining an exit opening, the exit opening being spaced from the aperture. The aperture and the exit opening are disposed along a common axis extending away from the support means and through the passageway.

The inner nozzle wall includes a first portion having a truncated cone-like configuration and leading from the support means to a first location spaced a first predetermined distance from the aperture.

The inner nozzle wall also includes a second portion connected to the first portion at the first location. The second portion has a substantially cylindrical configuration and terminates at the exit opening at a second location spaced a second predetermined distance from the aperture which is greater than the first predetermined distance.

In one embodiment of invention, the dispenser nozzle has an outer wall spaced from the inner wall and converging along substantially the full length thereof to define a truncated cone-like configuration along the length. The bottom wall extends between the outer wall and the inner wall. The inner wall second portion extends upwardly from the bottom wall to the inner wall first portion.

In another embodiment of the invention, a dispenser nozzle has a first outer wall portion spaced from the inner wall first portion and substantially co-extensive therewith. The nozzle also has a generally cylindrically shaped second outer wall portion substantially uniformly spaced from the inner wall second portion and substantially co-extensive therewith.

Other features, advantages, and objects of the present invention will become apparent with reference to the following description and accompanying drawings.

MODES FOR CARRYING OUT THE INVENTION

Figure 1:
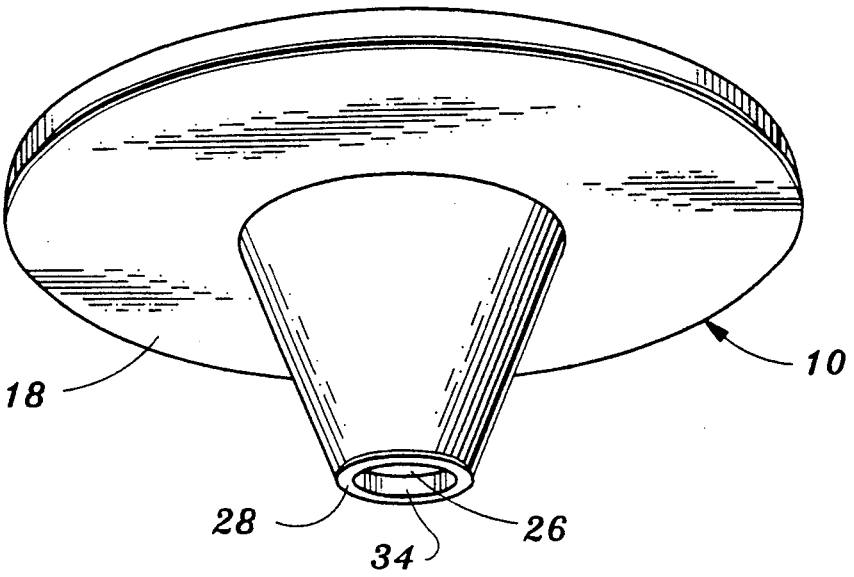
FIG. 1 is a bottom, perspective view of a dispenser nozzle constructed in accordance with the teachings of the present invention.

Referring now to FIGS. 1–6, a dispenser nozzle constructed in accordance with the teachings of the present invention is indicated by reference numeral 10.

Figure 2:
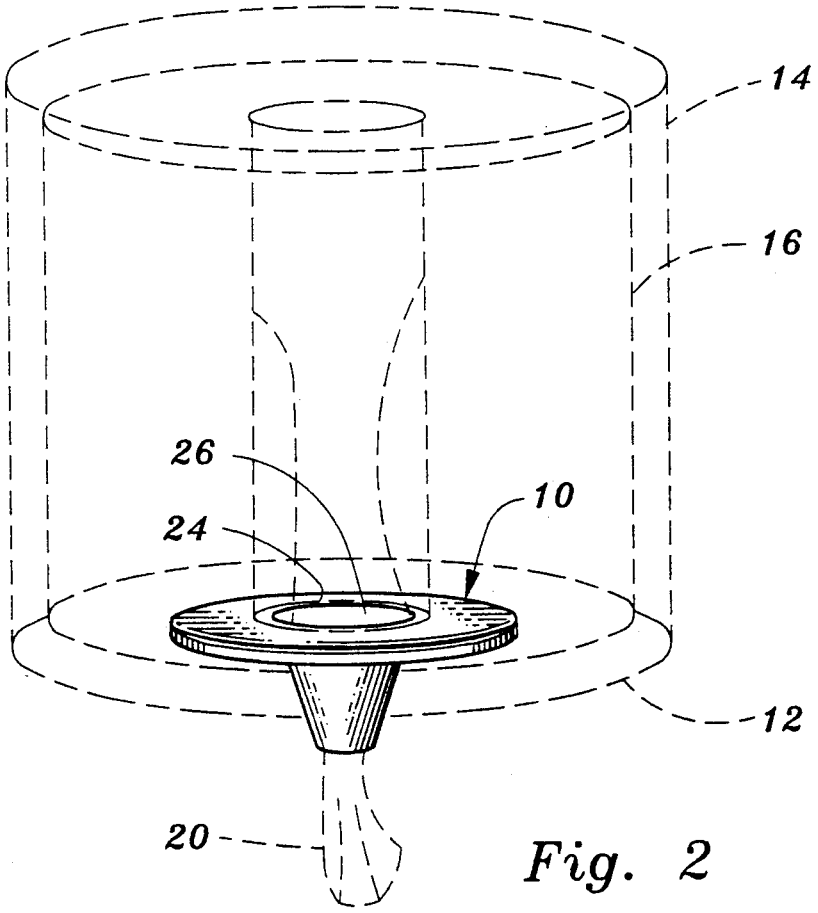
FIG. 2 is an upper, perspective view illustrating the position assumed by the nozzle of FIG. 1 when the nozzle is positioned on a support and under a coreless roll product being dispensed through the nozzle and support.
Figure 3:
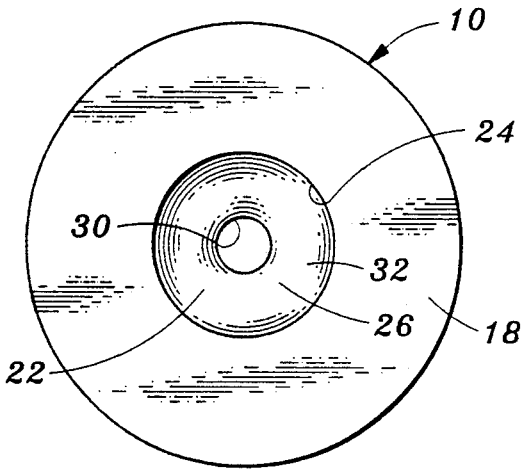
FIG. 3 is a top view of the nozzle.
Figure 4:
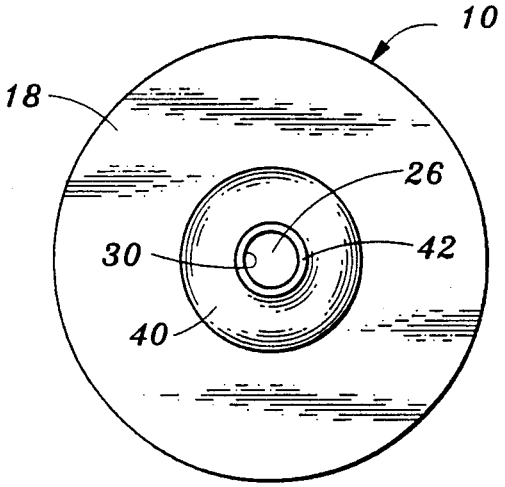
FIG. 4 is a bottom view of the nozzle.
Figure 5:
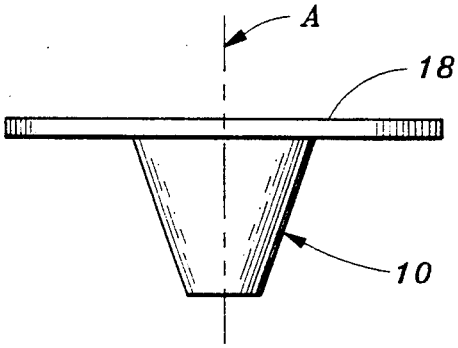
FIG. 5 is a side view of the nozzle.

Nozzle 10 may be constructed of any suitable material but preferably is of unitary, molded plastic construction. The nozzle 10 is for positioning on a support, for example the bottom wall 12 of a dispenser 14 (FIG. 2). A coreless roll product 16 comprising a plurality of paper towels forming a wound web and separated by perforation lines (not shown) is positioned within the dispenser and supported by the bottom wall. The roll may either be supported directly on the bottom wall or on the nozzle 10 which in turn is supported on the bottom wall. The latter arrangement is shown in FIG. 2 wherein the nozzle 10 has a flange 18 which is located on the support 12 and under the roll. A cone-like section or segment of the dispenser nozzle, which is described in detail below, projects downwardly through a hole formed in the support 12 and accommodates therein a lead end 20 of coreless roll 16.

Dispenser nozzle 10 defines an aperture 24 for receiving the lead end 20. An inner nozzle wall 22 defines a passageway 26 leading from the aperture 24 away from the support.

Dispenser nozzle 10 has a distal end 28 defining an exit opening 30. Exit opening 30 is spaced from aperture 24 and the aperture and exit opening are disposed along a common axis A extending away from the support means and through the center of the passageway 26.

The inner nozzle wall 22 includes a first portion 32 having a truncated cone-like configuration and leading from the support 12 to a first location spaced a first predetermined distance from the aperture. The inner nozzle wall also has a second portion 34 connected to the first portion at the first location. The second portion 34 has a cylindrical configuration and terminates at the exit opening 30 at a second location spaced a second predetermined distance from the aperture greater than the first predetermined distance. The inner nozzle wall first and second portions are concentrically disposed about axis A.

Dispenser nozzle 10 has an outer wall 40 spaced from inner wall 22 and converging along substantially the full length thereof to define a truncated cone-like configuration along said length. A bottom wall 42 extends between the outer wall and the inner wall. The inner wall second portion 34 extends upwardly from the bottom wall 42 to the inner wall first portion 32.

Figure 6:
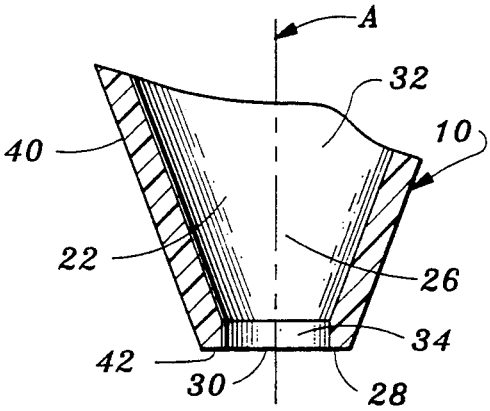
FIG. 6 is an enlarged, cross-sectional view illustrating the lower portion of the nozzle.
Figure 6A:
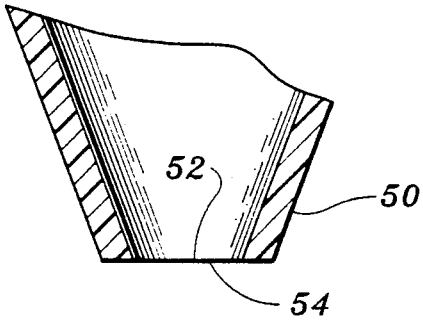
Fig. 6A PRIOR ART
FIG. 6A is a view similar to FIG. 6, but illustrating a prior art nozzle configuration.

To point out the advantages of the present invention, the structure just described will be compared with that of the prior art. FIG. 6A shows a cross-section of the bottom end of a typical cone-shaped dispenser nozzle for center pull dispensing. The prior art nozzle is designated by reference numeral 50 and the exit opening thereof is identified by reference numeral 52. It will be seen that the inner and outer walls of the nozzle 50 terminate at a common plane corresponding to the plane of the exit opening. This results in formation of a relatively sharp edge 54 at the exit opening. This not only results in relatively rapid wear of the nozzle at the exit opening but also can cause problems even in the early stages of dispensing due to frictional engagement between the sharp edge and the toweling being dispensed.

By contrast, the combination of the cylindrically shaped second portion 34 of the nozzle of this invention with the tapered first portion 32 results in a greater nozzle surface area to be contacted when toweling is dispensed through the exit opening 30. Also, there is no sharp edge engaged by the toweling during the dispensing operation. Such an approach adds considerably to the life of the nozzle in the vicinity of the exit opening thereof.

Preferably, the inner nozzle wall first portion radiates uniformly upwardly and outwardly from the inner nozzle wall second portion, i.e. deviates therefrom, at a predetermined angle falling within the range of from about 10 degrees to about 45 degrees. It is also preferred that the inner nozzle wall second portion extend upwardly from the exit opening a distance of about 4 millimeters. Such distance should be at least ½ millimeter and generally no greater than about 10 millimeters, the inner nozzle wall second portion being uniformly spaced from axis A.

Figure 7:
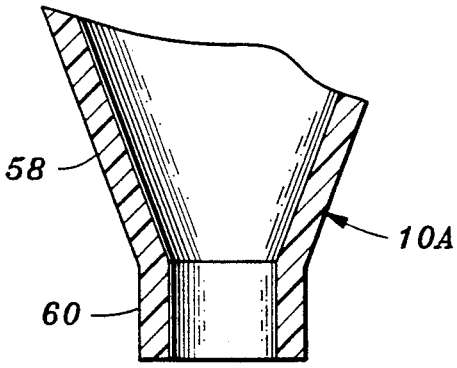
FIG. 7 is a view similar to FIG. 6, but illustrating an alternative embodiment of a nozzle constructed in accordance with the teachings of the present invention.

FIG. 7 illustrates an alternative embodiment wherein a nozzle 10A has a first outer wall portion 58 spaced from the inner wall first portion and substantially co-extensive therewith. Furthermore, nozzle 10A has a cylindrically-shaped second outer wall portion 60 substantially uniformly spaced from the inner wall second portion and substantially co-extensive therewith. This gives the lower end of nozzle 10A a appearance somewhat similar to a funnel. It will be appreciated that such an approach enables an inner nozzle wall second portion of virtually any length to be formed, not limited by the thickness of the dispenser nozzle wall.

I claim:

1. Apparatus for dispensing individual sheets form the center of a coreless roll product comprised of a plurality of said sheets forming a wound web having a lead end projecting outwardly from the roll center, said apparatus comprising, in combination:

support means for supporting said coreless roll; and a dispenser nozzle of unitary construction defining an aperture for receiving said lead end fixedly positioned relative to said support means and having an inner nozzle wall defining a passageway leading form said aperture away from said support means, said dispenser nozzle having a distal end defining an exit opening, said exit opening being spaced from said aperture and said aperture and said exit opening being disposed along a common axis extending away from said support means and through said passageway, said inner nozzle wall including a first portion having a truncated cone-like configuration and leading from said support means to a first location spaced a first predetermined distance from said aperture and a second portion connected to said first portion at said first location, said second portion having a cylindrical configuration and terminating at said exit opening at a second location spaced a second predetermined distance from said aperture greater than said first predetermined distance, said inner nozzle wall first and second portions being concentrically disposed about said axis with said inner wall first potion uniformly flaring outwardly away from said axis above said first location and said inner nozzle wall second portion being uniformly spaced from said axis along the entire length of said inner nozzle wall second portion between said exit opening and said first location, said inner nozzle wall first portion radiating uniformly upwardly and outwardly from said inner nozzle wall second portion at a predetermined angle falling within the range of from about 10 degrees to about 45 degrees, and said inner nozzle wall second portion extending upwardly form said exit opening a distance of at least ½ millimeter.

2. The apparatus according to claim 1 wherein said dispenser nozzle has an outer wall spaced from said inner wall and converging along substantially the full length thereof to define a truncated cone-like configuration along said length and a bottom wall extending between said outer wall and said inner wall, said inner wall second portion extending upwardly form said bottom wall to said inner wall first portion.

3. The apparatus according to claim 1 wherein said dispenser nozzle has a first outer wall portion spaced from said inner wall first portion and substantially coextensive therewith and a generally cylindrically-shaped second outer wall portion substantially uniformly spaced form said inner wall second portion and substantially coextensive therewith.

* * * * *